US006820457B2

(12) United States Patent
Luebke et al.

(10) Patent No.: US 6,820,457 B2
(45) Date of Patent: Nov. 23, 2004

(54) CONDUIT BENDER

(75) Inventors: Thomas M. Luebke, Menomonee Falls, WI (US); David A. Huebschen, Menomonee Falls, WI (US); Gary Janquart, Las Vegas, NV (US); Bernard J. Ziebart, Pewaukee, WI (US); David Weismann, Pewaukee, WI (US); Thomas Strunsee, Waukesha, WI (US)

(73) Assignee: Actuant Corporation, Milwaukee, WI (US)

( * ) Notice: Subject to any disclaimer, the term of this patent is extended or adjusted under 35 U.S.C. 154(b) by 0 days.

(21) Appl. No.: 10/376,199

(22) Filed: Feb. 26, 2003

(65) Prior Publication Data

US 2003/0233859 A1 Dec. 25, 2003

Related U.S. Application Data

(60) Provisional application No. 60/359,627, filed on Feb. 26, 2002.

(51) Int. Cl.[7] ..... B21D 7/14; B21J 13/08

(52) U.S. Cl. ..... 72/459; 72/31.4

(58) Field of Search ..... 72/458, 459, 31.4

(56) References Cited

U.S. PATENT DOCUMENTS

| | | | | | |
|---|---|---|---|---|---|
| 2,847,705 | A | * | 8/1958 | Hellwig | 72/458 |
| 3,063,314 | A | * | 11/1962 | Benfield et al. | 72/459 |
| 4,009,602 | A | | 3/1977 | Linquist | |
| 4,063,444 | A | * | 12/1977 | Vecho, Jr. | 72/459 |
| 4,425,784 | A | | 1/1984 | D'Gerolamo | |
| 4,442,695 | A | * | 4/1984 | Gardner | 72/459 |
| 5,816,095 | A | * | 10/1998 | Nordell, II et al. | 72/458 |
| 5,927,141 | A | | 7/1999 | Walsten | |

* cited by examiner

*Primary Examiner*—David Jones
(74) *Attorney, Agent, or Firm*—Quarles & Brady LLP

(57) ABSTRACT

A plastic conduit bender comprises an integrally molded handle and head portion. A steel hook reinforcement is molded directly into the head portion to provide sufficient force for bending the conduit. Steel reinforcements can also be provided in a grip region of the handle. A plurality of vertical sight lines, indicating bend angles, are provided from an apex molded into the handle and extending to an arcuate shoe portion, allowing the user to gauge the approximate bend angle. A flat surface including rounded saddle portions for receiving the conduit is positioned on the handle to allow the conduit to be bent back or straightened, the rounded saddle contact surfaces preventing damage to the conduit as it is bent back.

34 Claims, 10 Drawing Sheets

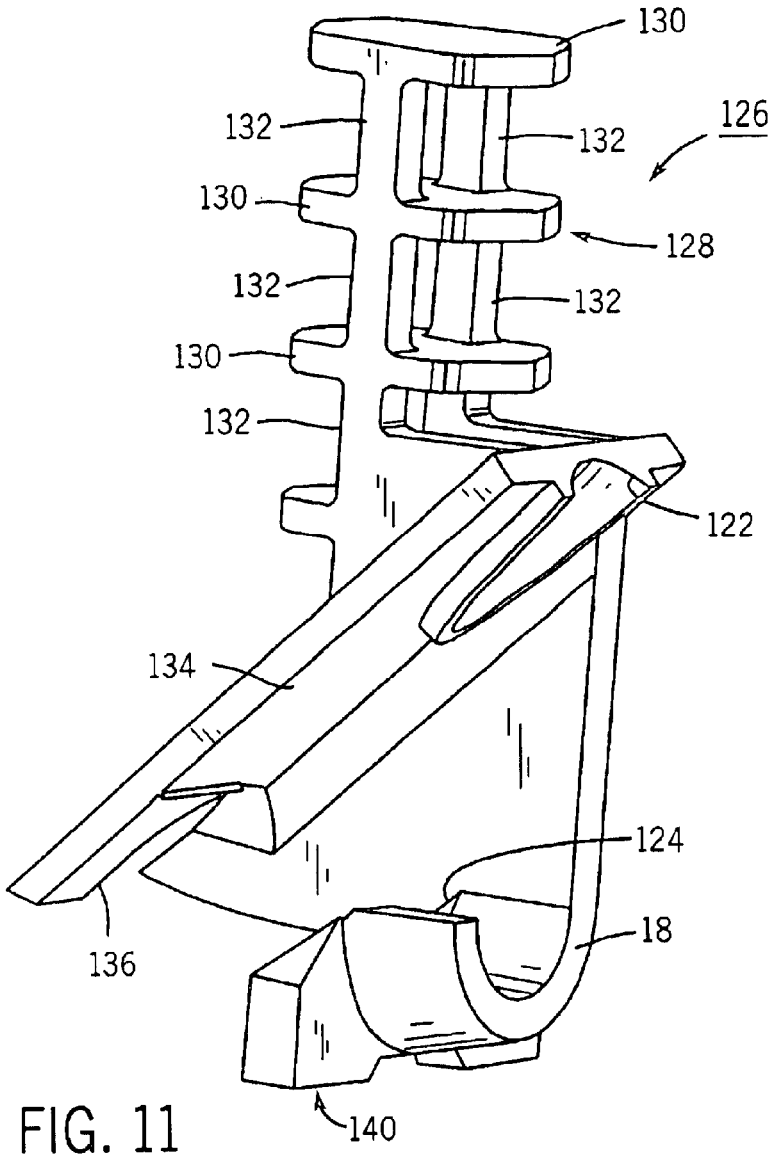
FIG. 11
FIG. 14
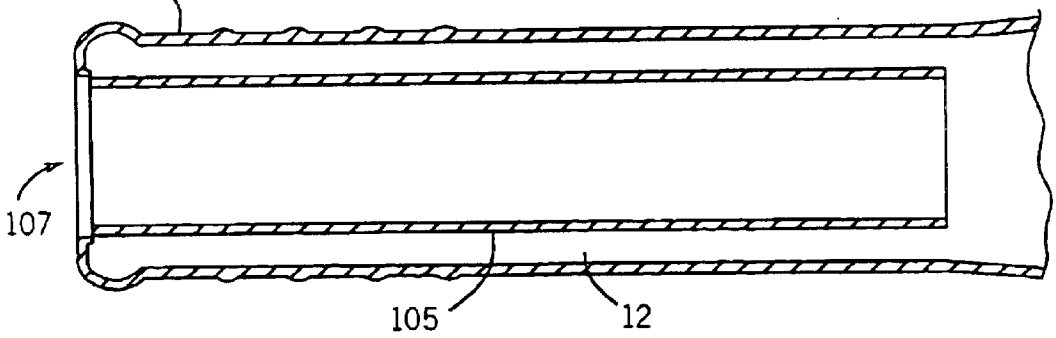

CONDUIT BENDER

CROSS-REFERENCE TO RELATED APPLICATION

This claims the benefit of U.S. provisional patent application No. 60/359,627 entitled "Conduit Bender" filed Feb. 26, 2002.

STATEMENT CONCERNING FEDERALLY SPONSORED RESEARCH OR DEVELOPMENT

Not applicable.

FIELD OF THE INVENTION

This invention relates to conduit benders for bending electrical conduit, and in particular to a molded plastic conduit bender.

BACKGROUND OF THE INVENTION

Conduit benders are well known and typically include a cast steel or aluminum alloy head and a separate handle, which may also be made out of steel, which is screwed into the head. The head has a curved shoe with a concave channel into which the conduit fits fairly closely so as to support the sides of the conduit from buckling as the conduit is being bent. The end of the conduit is hooked under a hook of the shoe and then bent in either of two ways. One way is with the conduit flat against the floor and the user rotating the handle, typically with the user's foot on the end of the shoe which is opposite from the hook and with the user rotating the handle, so as to bend the conduit against the floor. The head typically has angle markings along the side of the shoe so that the user can approximate the angle to which the user is bending the conduit. An alternative way of bending conduit using a typical bender is to grab the handle up near the head with one hand, grab the conduit with the other hand, and place the end of the handle against the floor while bending the conduit around the shoe. Users bend the conduit in one way or the other depending upon personal preference.

Although benders such as those described are generally suitable for bending pipes and conduits, there are a number of problems associated with typical prior art conduit benders. For example, if a conduit is bent beyond a selected bend angle, the conduit can only be straightened or bent back to the selected angle by reversing the direction of bending. As the conduit bender is designed to operate only to bend the conduit in one direction, the contact surfaces on the conduit typically kink or gouge the conduit if the conduit needs to be bent backward. Under these circumstances the conduit may need to be discarded and the bend process restarted with a new length of conduit.

Furthermore, angle gauge markings can be difficult to read on prior art conduit bending devices. For example, when using the conduit "against the floor" method of bending, the angle gauge markings on the side of the head are difficult to read. When using the "handle against the floor" method, these marks are not positioned appropriately to determine the bend angle, and the bend angle must therefore be approximated by the user.

Another problem with prior art conduit benders is that these devices are relatively heavy, and therefore can be difficult for many users to operate. Additionally, typical conduit benders come in multiple pieces, comprising at least a separate head and a handle, and therefore require assembly prior to use. Furthermore, the handles can become disassembled from the heads during use, decreasing efficiency of bending operations. Also, typical prior art benders are constructed of conductive, typically metal, materials. As these devices are frequently used in and around electrical installations, non-conductive devices are preferable.

There remains a need, therefore, for an improved conduit bender.

SUMMARY OF THE INVENTION

The invention provides a molded plastic conduit bender, the conduit bender comprising a handle and an integrally-molded arcuate shoe portion including a channel conduit to be bent.

In one aspect, a steel hook is insert molded into the handle adjacent an end of the arcuate shoe portion, such that a conduit provided in the shoe is receivable in the hook to be bent to a selected angle. The plastic material of the bender is non-conductive, relatively lightweight, durable, and inexpensive to manufacture. The unitary construction of the handle and head also results in a very secure attachment between the handle and head, which is not prone to becoming unscrewed or detached.

To strengthen the handle during bending operations, steel tubes can also be insert molded into the handle in locations at which the user is expected to grip the handle. The steel tube is hollow such that a conduit can be slipped inside the steel tube in the handle to gain additional leverage to bend the conduit.

The invention also provides a head of a conduit bender including a plurality of sight lines extending vertically from an apex on a side of the handle. The sight lines are positioned on the handle to mark bend angles, such that an operator can look down along the handle at the shoe and gauge the amount of bend in the conduit. A second set of horizontal sight lines provided along an edge of the arcuate shoe can also be provided, to allow for gauging the bend angle when an alternate method of bending the conduit is used. Recessed numerical angle markings, molded into the handle, can provide a numerical indication of the bend angle for each set of sight lines. The numerical angle markings are both recessed and permanently marked to prevent wearing when the conduit bender is laid on a side.

The invention also provides a method and apparatus for straightening or "bending back" a conduit that has been bent beyond a desired angle. A first rounded saddle portion is provided on a side of the handle opposite the hook, and a second rounded saddle portion is provided on the hook. The first and second saddle portions are sized and dimensioned to receive the conduit, and are further spaced a distance apart wherein the conduit can be received between the first and second saddles. When the handle is rotated in a direction opposite the bending direction, the conduit provided between the first and second saddle portions engages, and is cradled by the two saddle portions. Further rotation of the handle in the backward direction causes the conduit to bend back. As the conduit is only contacted by the saddle portions during the bend back operation, the contact surfaces for the conduit are the rounded saddle portions which prevent kinking or damage to the conduit.

The invention also provides a hole in a molded plastic handle for a user to grab the handle adjacent to the head to facilitate bending electrical conduit in the handle against the floor method above, with the handle against the floor and the user grabbing the conduit and bending it about the head, or for carrying the bender. The molded plastic handle, being relatively wide adjacent to the head, has ample room to form a handle hole between its sides to accommodate the fingers of a user as the user grabs the handle. Preferably, the sides of the handle hole and the sides of the handle adjacent to the handle hole are radiused for the comfort of the user. This way, the user can get a firm grip on the handle when grabbing it adjacent to the head and bending the tubing about the head. The main handle and this handle may also be overmolded with an elastomer which is softer than the other plastic portions of the bender.

In another feature of the invention, one or more vice apertures are provided in the handle of the conduit bender. The apertures are sized and dimensioned to receive the conduit, wherein it is gripped in the vice apertures such that the conduit can be cut, de-burred, or otherwise modified. The vice apertures can be provided with an elastomer coating, both to improve the gripping force and to prevent damage to the conduit while held in the vice.

In another feature, the base of the head, adjacent to the tubing receiving arcuate channel, can be provided with markings on it to indicate the angle at which the tubing is bent about the head. This facilitates determining the angle of bend particularly when the second mentioned method of bending is used above, whereby the user grasps the handle adjacent to the head and grasps the tube with the other hand and bends it about the head. That way, the user does not have to strain to see the side of the shoe, but can look at the base of the shoe which he is naturally facing when bending tubing using this method.

The foregoing and other objects and advantages of the invention will appear in the detailed description which follows. In the description, reference is made to the accompanying drawings which illustrate a preferred embodiment of the invention.

BRIEF DESCRIPTION OF THE DRAWINGS

FIG. 11 is a perspective view of a steel hook insert of the conduit bender of FIG. 8.

FIG. 14 is a cutaway view of the grip end of the handle of FIG. 8.

DETAILED DESCRIPTION OF THE PREFERRED EMBODIMENT

Figure 1:
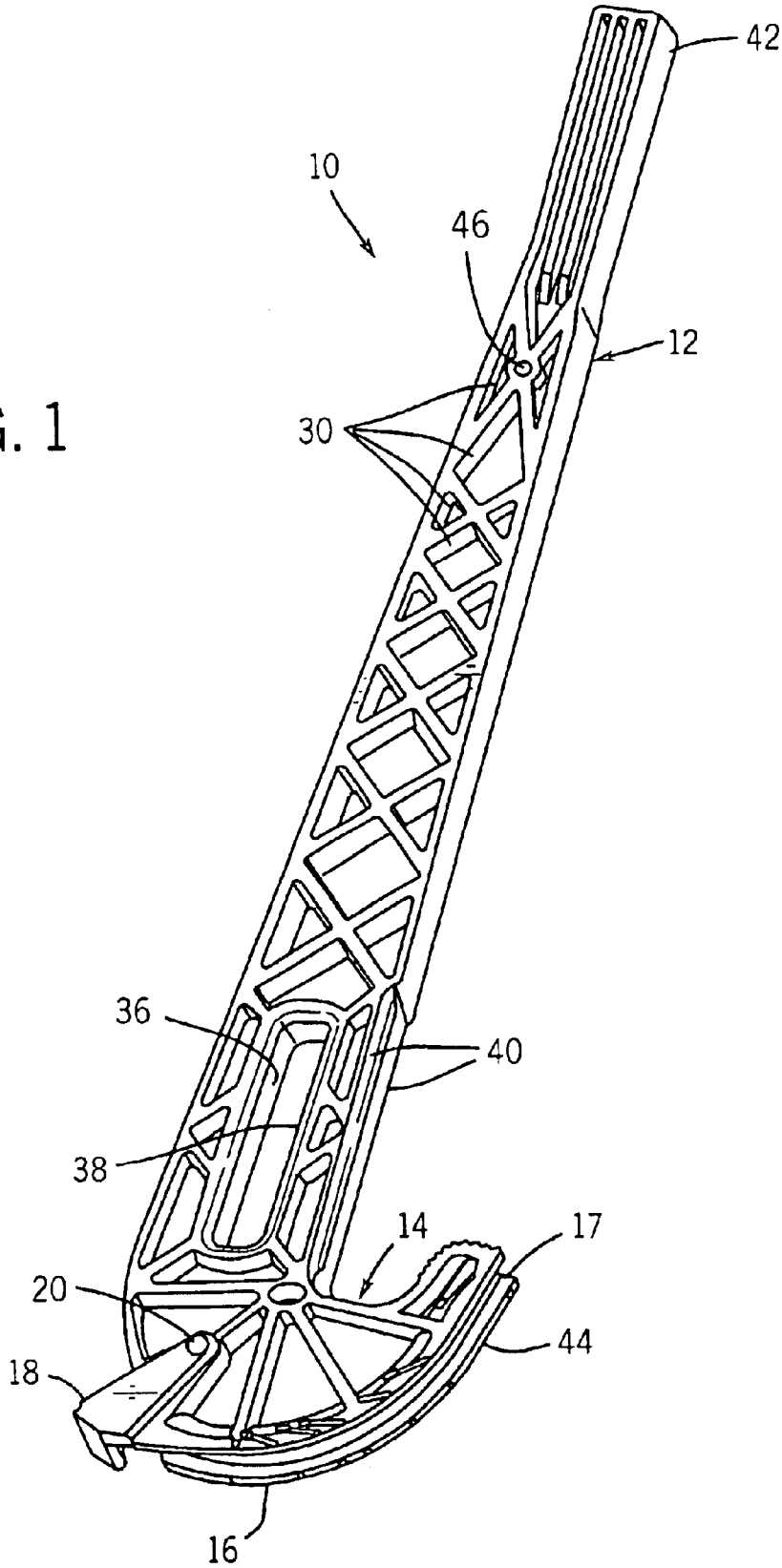
FIG. 1 is a perspective view of a conduit bender of the invention.
Figure 2:
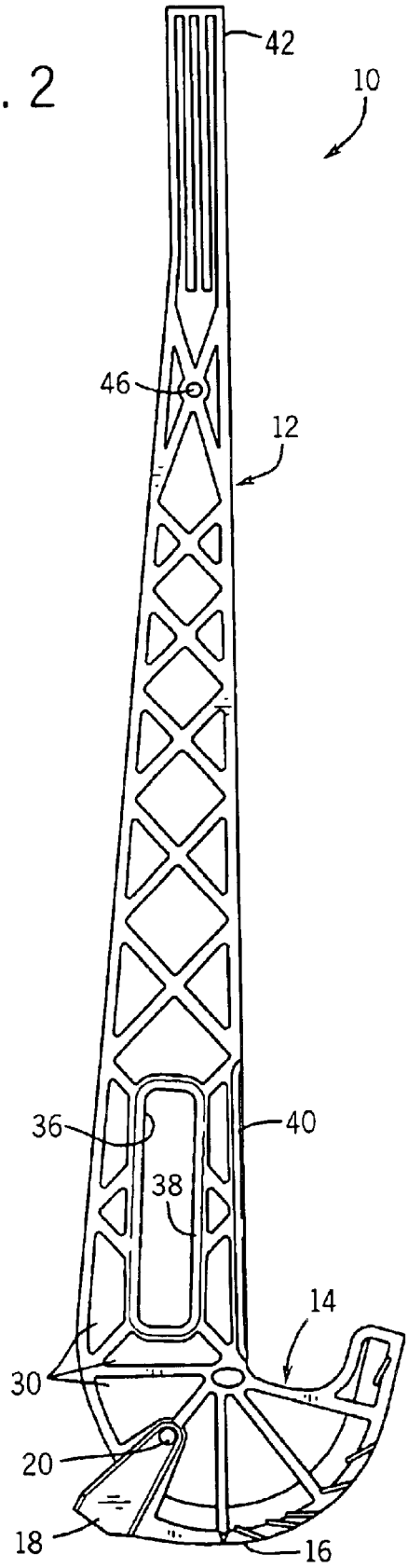
FIG. 2 is a right side plan view of the conduit bender of FIG. 1.
Figure 3:
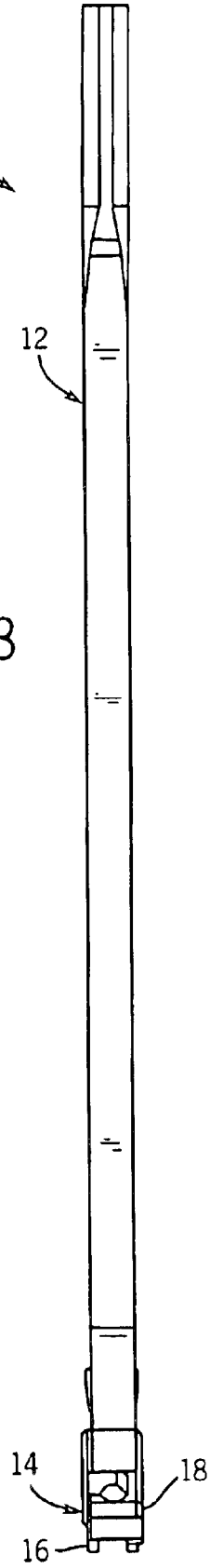
FIG. 3 is front plan view of the conduit bender of FIG. 1.

Referring now to the figures, and more particularly to FIGS. 1, 2, and 3, the bender 10 has a handle 12 integral with a head 14 which defines an arcuate shoe 16 into which electrical conduit to be bent is received. The channel 17 of the shoe 16 may be sized to any size of electrical conduit, for example, one-half inch or three-quarter inch. A steel hook 18 is pivotally attached to the head 14 by pin 20 which is secured to the hook 18 by a press fit. The hook 18 is hooked over the end of a conduit to be bent prior to bending the conduit in the channel of the shoe 16. The handle 12 is preferably molded out of plastic, for example, 30% glass filled nylon 6/6. Alternatively, it could be a long fiber polypropylene, or other suitable plastic.

Figure 4:
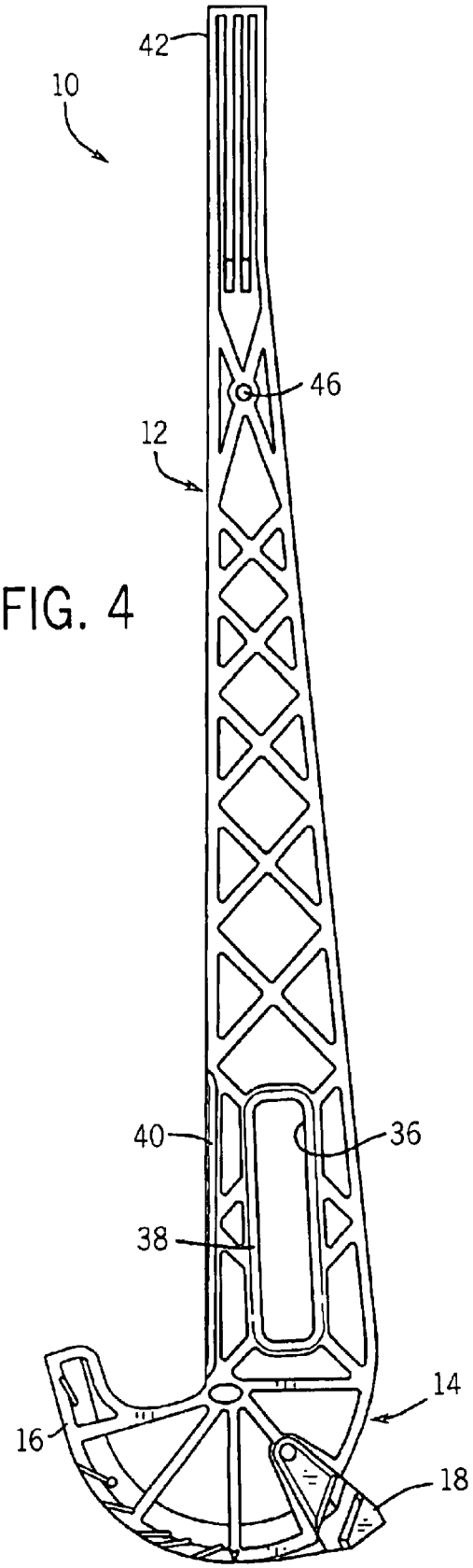
FIG. 4 is a left side plan view of the conduit bender of FIG. 1.

The bender 10 is approximately 38 inches long and is molded with reinforcing shapes, including recessed webs 30 (not all of which are labeled), which are approximately one-quarter inch thick, which are surrounded by reinforcing ribs on both sides of the handle as shown in FIGS. 1, 2 and 4. The total thickness of the conduit bender 10 is approximately 1.1 inches in the handle 12 and may be thicker in the shoe 16 depending upon the diameter of tubing that the bender 10 is sized for.

Adjacent to the head 14, a hand hole 36 is formed in the handle 12. The rear side of the handle 12 adjacent to the hand hole 36 has its corners radiused at 40 for the comfort of the user. The corners 38 of the hand hole 36 directly opposite from the radiused corners 40 are also radiused for the comfort of the user. This is where a user grasps the handle 12, for example, with his left hand, while grasping the tubing to be bent with his right hand, hooking the tubing to be bent under the steel hook 18, and rotating the tubing about the shoe 16 so as to bend it. This is typically done with the opposite end 42 of the handle 12 against the floor to stabilize the bender 10 and prevent it from rotating, as described above.

Figure 5:
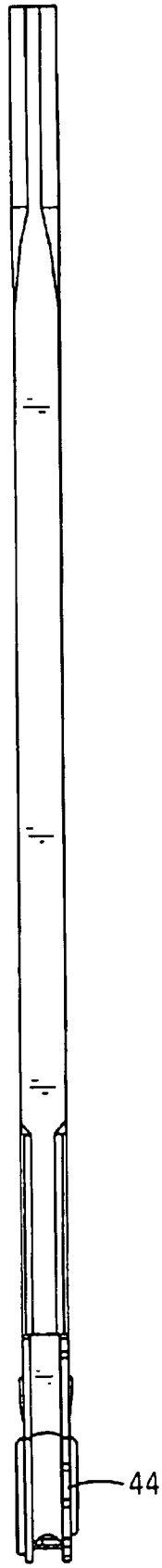
FIG. 5 is a rear plan view of the conduit bender of FIG. 1.
Figure 6:
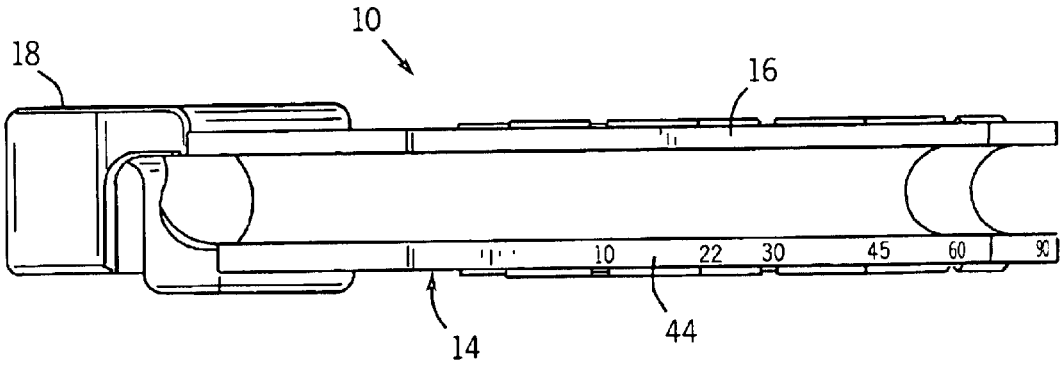
FIG. 6 is bottom plan view of the conduit bender of FIG. 1.
Figure 7:
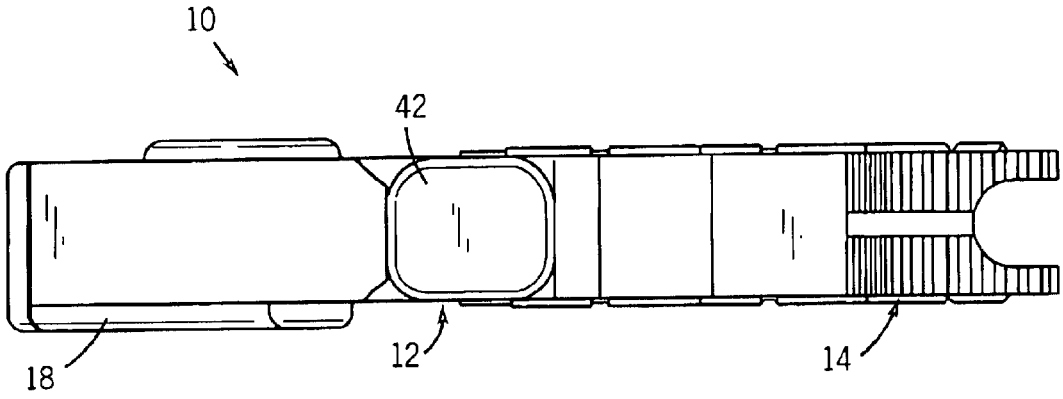
FIG. 7 is top plan view of the conduit bender of FIG. 1.

Referring to FIGS. 1, 5 and 6, recessed angle markings indicating bend angles at 10, 30, 45, 60, and 90 degrees are molded into the base surface 44 of the shoe 16 so that when a user is bending a conduit with the user's hand in the hand hole 36, the user can read the angled of bend from the rear of the bender 10, off of the surface 44. Since the angle numbers 10, 22, 30, 45, 60, and 90 are recessed into the base surface 44, they do not interfere with rotating the base surface 44 against the floor while a conduit is bent against the floor.

In addition to the hole 36, the handle 12 includes another hole 46 closer to its grip end 42. The hole 46 is for hanging the bender up on a pin or peg, for example, on an electrician's truck when storing the bender.

Referring now to FIGS. 8–14, a second embodiment of a conduit bender 10 is shown. As described above, the handle 12 of the conduit bender 10 comprises a plastic material preferably molded, for example, of a long fiber polypropylene or other suitable plastic. In the embodiment shown and described here, the hook portion 18 includes a steel insert 126 (FIGS. 11–13) which is insert molded into the handle 12 to provide a strong, stiff hook portion of the handle 12 for bending the conduit. One or more steel tube inserts can also be provided in handle grip 43 as shown in FIG. 14, stiffening the plastic handle 12 in this location for bending purposes, as described below.

Figure 8:
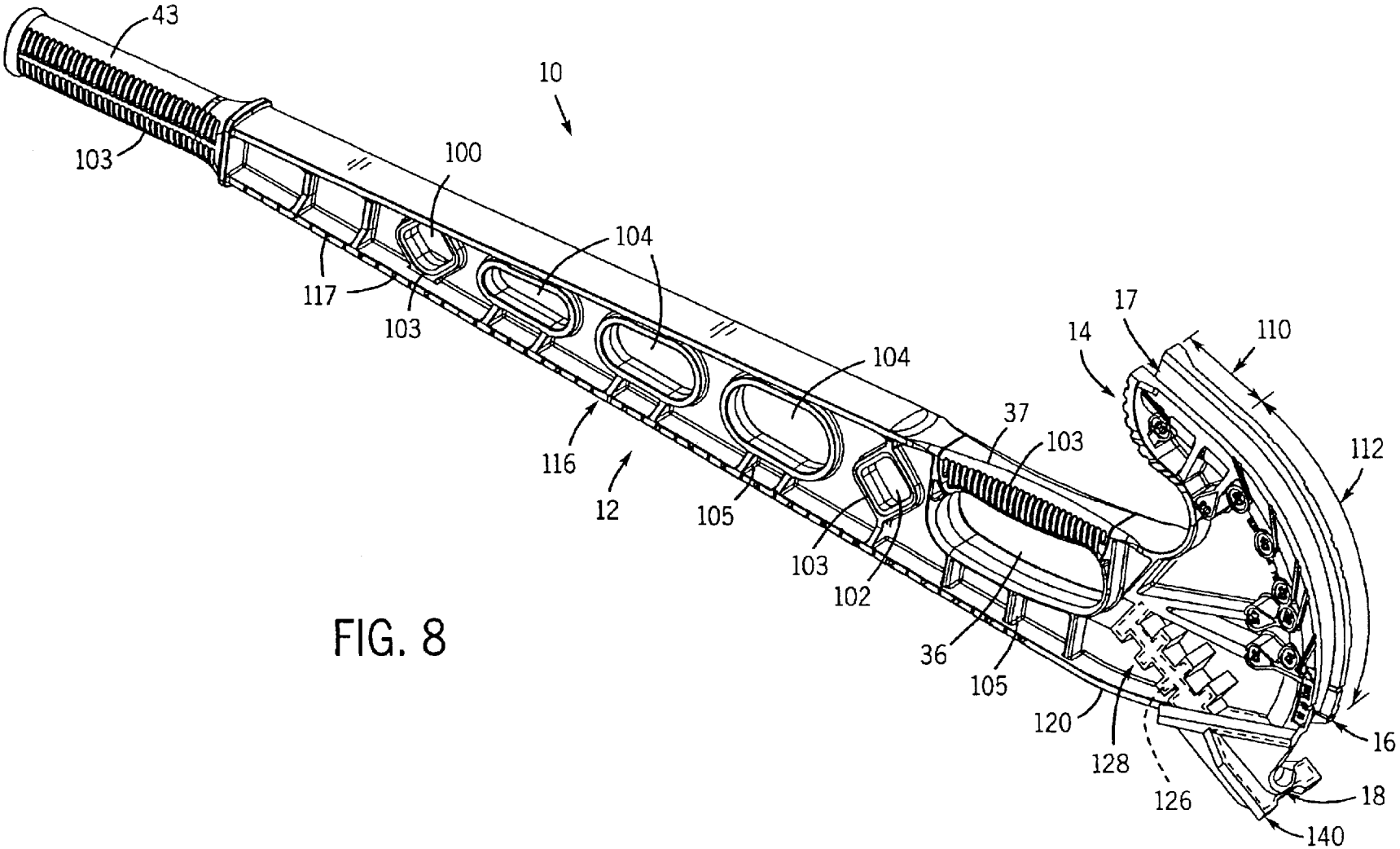
FIG. 8 is a perspective view of a conduit bender constructed in accordance with a second embodiment of the invention.

Referring now to FIG. 8, the bender 10 includes a shoe 16 integrally molded to the handle 12. A concave channel 17 is provided in the shoe 16 for receiving a conduit of a selected size, typically a one-half inch or a three-quarter inch diameter conduit. The conduit is further received in a hook 18 which is also sized and dimensioned to receive a conduit provided in the channel 17. The handle 12 further comprises a hand hole 36 positioned near the shoe 16 and including a handle grip 37 comprising radiused corners 38 and 40. A second hand grip 43 is provided at the opposing end of the handle 12 opposite the shoe 16. The grips 37 and 43 are preferably coated with a thermoplastic elastomer (TPE) 103 which allows an operator to comfortably grasp and hold the bender 10 both during an initial bending and a straightening or "bend back" process as described more fully below. To provide sufficient force during bending, one or both grips 37 and 43 can further be provided with a steel tube insert, shaped and dimensioned to be molded into the grips 37 and 43. Referring now also to FIG. 14, the steel tube insert 105 in handle 43, which is hollow and has an open end 107, also enables inserting the end of a conduit into the insert reinforced handle to gain additional leverage on a conduit being bent.

Referring still to FIG. 8, the interior of the plastic handle 12 is recessed as compared to the side walls, and includes a plurality of apertures 104 along the length of the handle 12. These apertures serve to limit the amount of plastic employed in the handle 12 and further provide an aperture for mounting the bender 10 to a peg or nail on a wall. Reinforcement ribs 105 are provided in the recessed interior extending between the apertures 104 and the side walls of the handle 12.

The handle 12 further comprises first and second vice apertures 100 and 102. The first and second vice apertures 100 and 102 are substantially rectangular and are positioned in the handle 12 with a diagonal of the rectangle parallel with the longitudinal axis of the handle 12, in a diamond-like configuration. The vice apertures 100 and 102 are sized and dimensioned to receive and grip a conduit for cutting and de-burring and each may be overmolded with a thermoplastic elastomer (TPE) 103 both to provide a gripping force and to prevent damage to the conduit at is gripped in the vice aperture 100 and/or 102.

Figure 9A:
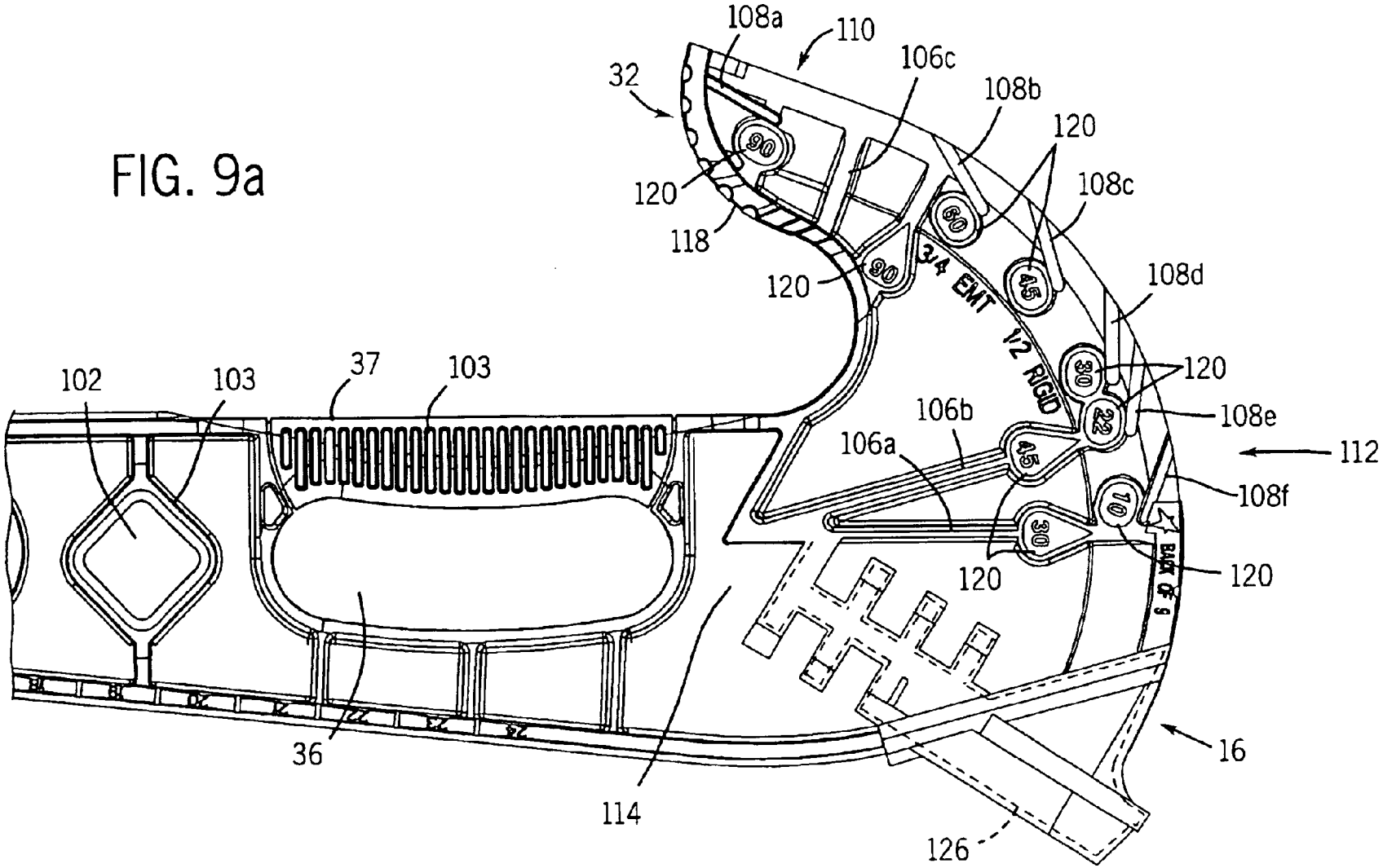
FIG. 9*a* is a close-up view of the head portion of the conduit bender of FIG. 8.

Referring now to FIG. 9*a* a close-up view of the head 14 including the shoe 16 of FIG. 8 is shown. As described above, the shoe 16 comprises a concave channel 17 for receiving the conduit. The channel 17 comprises both a straight portion 110 and an arcuate portion 112, wherein the arcuate portion 112 is positioned adjacent the hook 18 for receiving the conduit, and the straight portion 110 is positioned between the associated portion 112 and a pedal 32 including a plurality of ridges or grips 118 for receiving the foot of an operator applying a force to rotate the shoe 16. The straight portion 110 of the concave channel 17 is dimensioned to locate the pedal 32 a distance from the handle 12 to allow the foot of the operator to be positioned on the shoe 16 without interfering with the handle 12 or the bending operation and a distance from the arcuate portion 112, which ends at the 90 degree marking 106*c*, to produce leverage. As described below, the pedal 32 can be operated in conjunction with the hand grip 43 to rotate the bender 10 against the floor, thereby providing a force for bending the conduit in the channel 17 and hook 18.

Referring still to FIG. 9*a*, a plurality of vertical sight lines 106*a*, 106*b*, and 106*c* are molded into the handle 12 and extend from an apex 114, which is substantially centered along the axis of rotation of the handle 12. The sight lines 106*a*, 106*b*, and 106*c* are positioned in line with a 30 degree, a 60 degree, and a 90 degree bend angle, respectively, and allow a user to view the bend angle while operating the bender 10. The vertical sight lines 106 are useful when the bend is performed by the "conduit against the floor" method. In this method, as described above, a conduit is laid flat against the floor, a foot is positioned on the pedal 32 of the shoe 16, and the handle 12 is rotated, so as to bend the conduit against the floor. The sight lines allow the user to look down along the handle 12 and gauge the approximate bend angle of the conduit with reference to the apex 114 while in the bending process. The lines extending all of the way to the apex 114 help a user determine when the desired angle line is vertical, which lets the user know when to stop bending.

A second set of horizontal sight lines 108*a* (90 degrees), 108*b* (60 degrees), 108*c* (45 degrees), 108*d* (30 degrees), 108*e* (22 degrees), and 108*f* (10 degrees) are also molded into an edge of the shoe 16 along the arcuate portion 112 of the channel 17, located to extend substantially perpendicular to an underlying contact surface at the expected bend angle. These horizontal sight lines 108 are useful in determining the bend angle when the bender 10 is operated in the alternate method, grabbing the handle 12 through the hand hole 36 near the shoe 16 with one hand, grabbing the conduit with the other hand, and placing the end 43 of the handle 12 against the floor while bending the conduit around the shoe 16. Here the user does not view the angle from the handle 12, as described above, but rather determines the angle with reference to the markings on the edge of the shoe 16.

Figure 9B:
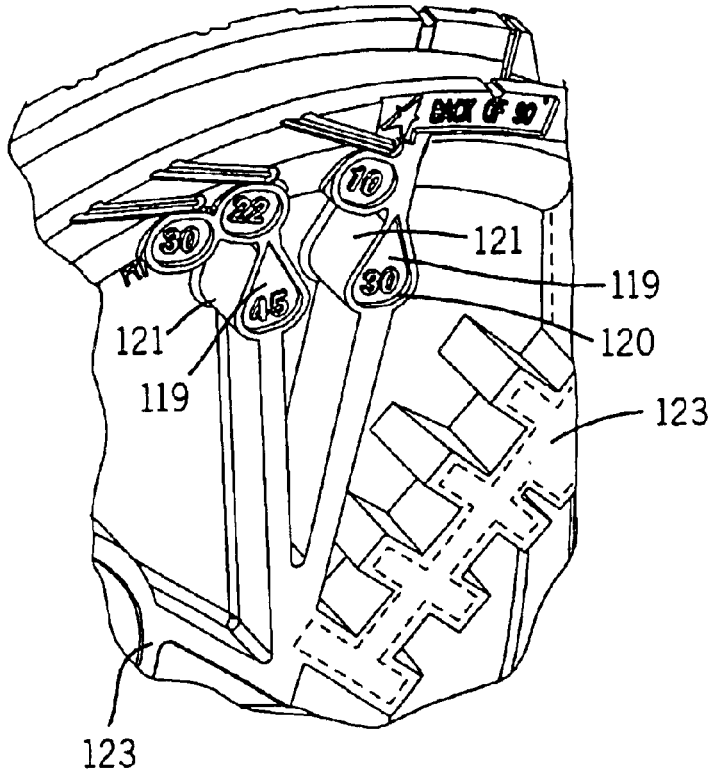
FIG. 9*b* is a close-up cutaway view of the numerical angle markers of FIG. 8.
Figure 9C:
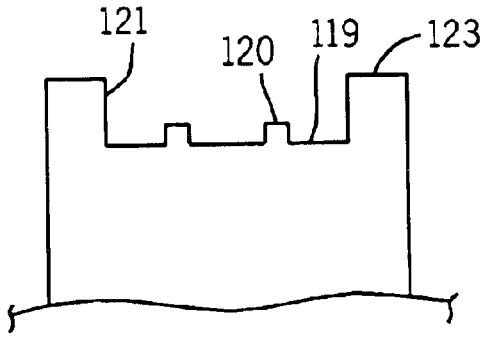
FIG. 9*c* is a cutaway view through a numerical angle marker of FIG. 9*b*.

Referring now to FIGS. 9*a*, 9*b*, and 9*c*, each of the vertical 106 and horizontal 108 sight lines includes a numerical angle marker 120, the numerical angle markers 120 being molded into the handle 12, and provided at an end of, in, or adjacent the sight lines 106 and 108 to provide a visual indicator to the operator of the numerical angle to which the conduit is being bent. The numerical angle markers 120 comprise numbers provided on an inset base 119, the base 119 and the numbers 120 recessed a distance below the contact surface 123 of the handle 12 such that when the handle is placed on its side and against a surface, the numerical angle markers 120 do not contact the surface and, therefore, cannot be easily rubbed off or otherwise accidentally removed. As shown, the contact surface of the handle 12 typically includes walled enclosures 121 which are provided around each of the inset base portions 119 of the numerical angle markers 120, preventing contact of the base 119 with a surface. The outer surfaces of the number provided by the numerical angle markers 120, furthermore, are either burned to blacken them (for example, if the plastic is red) or provided in indelible ink further limiting the possibility of accidental removal of the angle markers 120 and to make them more legible. Therefore, the numerical angle markers 120 are not worn off when, for example, the bender 10 is repeatedly laid or slid on a concrete surface.

Referring still to FIG. 9*a*, a ruler 116 comprising a plurality of spaced distance markings 117 is further provided in the handle 12 extending from a zero position 120 molded into an edge of the handle 12 and providing an increment every inch to a twenty-four inch mark located at the opposing end of the handle adjacent the handle 43. A similar ruler, extending from a zero point adjacent the handle 43 to a twenty-four inch point on the side of the handle opposite the zero point 120, is produced on the opposite side of the handle 12. The ruler 116 allows a user to measure conduit both during and independently of the bending process, and can be further used for measuring electrical conductors to be provided in the conduits, and for other measuring functions. Although the ruler 116 is described as a measure of inches, it will be apparent that the ruler 116 could embody other measuring systems, such as a metric scale. Furthermore, more detailed incremental measurement marks could also be provided.

Figure 10:
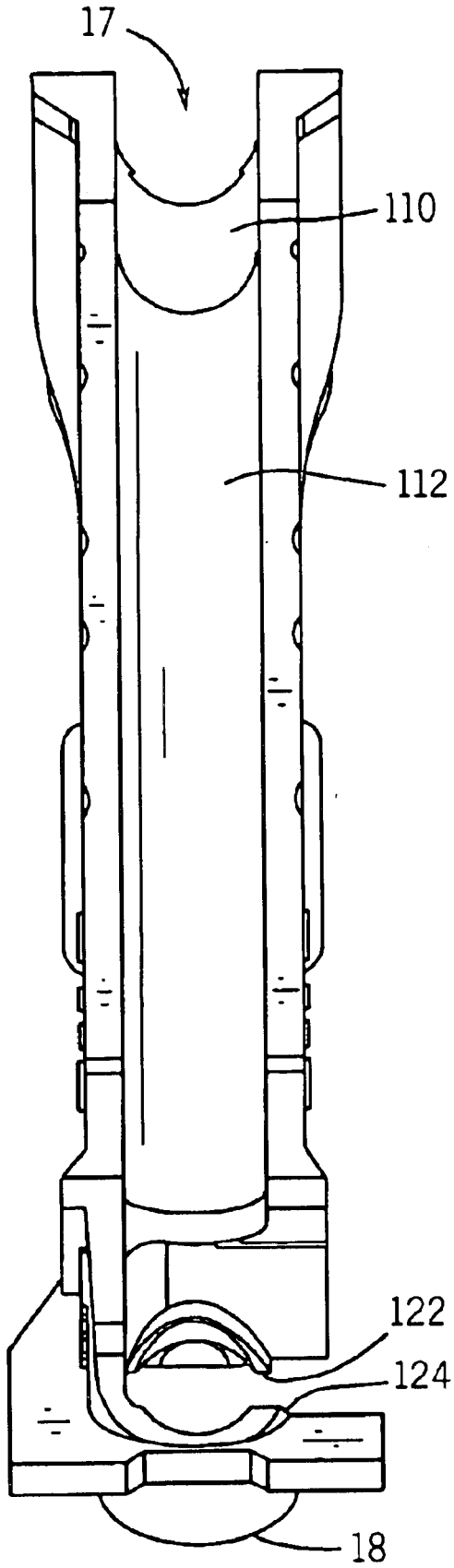
FIG. 10 is a bottom view of the head portion of the conduit bender of FIG. 8.

Referring now to FIG. 10, a bottom view of the shoe 16 of the bender 10 is shown. As described above, the channel 17 comprises a straight portion 110 and an arcuate portion 112, the arcuate portion 112 ending adjacent a hook 18 comprising the steel insert portion 126 (FIGS. 11–13) embedded in the plastic handle 12 as described more fully below. Two rounded saddle portions 122 and 124, sized and dimensioned for receiving the conduit are provided on a back side of the hook 18 adjacent the channel 17, and on a straight portion of the handle 12 opposite the hook 18, respectively. The saddles 122 and 124 provide a channel for aligning and retaining a straight portion of conduit when bending the conduit back or straightening the conduit as, for example, after an initial bend has exceeded the desired bend angle. The rounded contact surfaces of the saddles 122 and 124 prevent kinks and gouges from being formed in the conduit during a bend back or straightening operation, as described below.

Referring now to FIGS. 8 and 11, as described above, a steel hook insert 126 is embedded into the plastic handle 12, extending substantially from the apex 114 in the handle 12 and ending at the hook 18. The steel hook insert 126 is received in the handle and covered uniformly with a layer of plastic. Therefore, the shape of the surfaces of the steel insert 126 are identical to those of the bender 10.

Referring still to FIGS. 8 and 11, the steel hook insert 126 comprises a mounting grid portion 128 including a plurality of flange horizontal surfaces 130 coupled together by vertical columns 132. The flange surfaces 130 and vertical columns 132 are configured to leave a portion of the mounting grid 128 between columns 132 open wherein molten plastic can fully surround the mounting grid during the molding process, thereby providing a sufficiently strong attachment between the steel hook insert 126 and the plastic of the bender 110 to minimize or prevent breakage when bend forces are applied.

The mounting grid 128 is coupled to an angled mounting or flat surface 134 including a semicircular cutout 136 at a first end, shaped and dimensioned to mate with the concave channel 17 in the shoe 16 as shown in FIG. 8, and a concave elliptically-shaped saddle portion 122 provided at the opposing end. The flat surface 134 is positioned opposite the hook 18, and is angled at an angle selected to couple the substantially vertical side of the handle 12 to the arcuate section 112 of the channel 17, when molded into the handle 12, and further to maintain the handle portion out of the way of a bend back process, as described below. The insert 126 is fully imbedded in the plastic of the bender 110, with for example approximately at least a 1/16 in thickness of plastic covering it.

Figure 12:
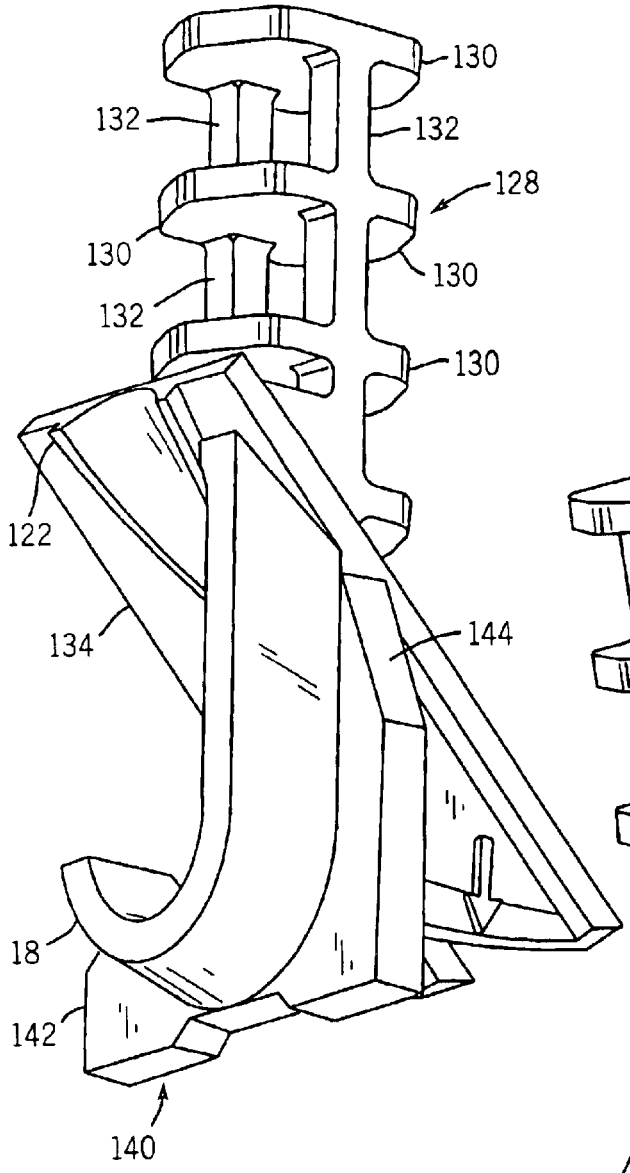
FIG. 12 is a perspective view of the steel hook insert of FIG. 11 from a second angle.

The hook 18 is substantially J-shaped, the long side of the J being coupled to the flat surface 134 through an extended, substantially triangular-shaped vertical wall surface 136 sized and dimensioned to enclose the surface between the hook 18 and the side of the handle 12, again as installed in the bender 10. The hook 18 is further coupled to a mounting platform 140 having a substantially flat bottom portion which allows the hook 18 to rest against a contact surface when in use. Referring now also to FIG. 12, the mounting surface 140 further comprises reinforcement walls 140 and 142 which are buttressed against the long and the short sides of the J-shaped hook 18, respectively, providing a strong and stiff hook for bending a conduit or tube.

Figure 13:
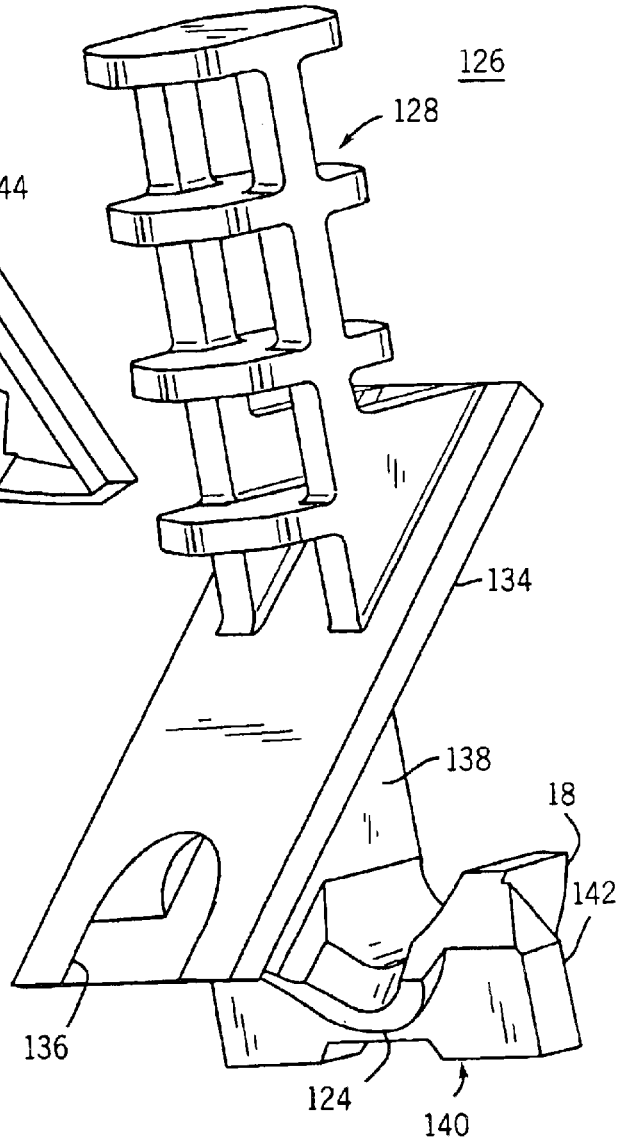
FIG. 13 is a perspective view of the steel hook insert of FIG. 11 from a third angle.

Referring now also to FIG. 13, a rear view of the steel insert 126 is shown illustrating, in particular, the saddle 124 extending from the back side of the hook 18 adjacent the channel entry 136. The saddle 124 is an arcuate section sized and dimensioned to receive the conduit, and is sloped at an angle substantially parallel to the saddle 122, and spaced a distance apart from the saddle 122 such that a conduit of the size expected to be bent by the bender 10 can be held in a channel provided between the saddles 122 and 124 for bending the conduit back, as described below.

Referring now to FIG. 8, to provide a bend in a length of conduit, a length of conduit extending along a contact surface beneath the channel 17 is engaged in the hook 18. A force is applied to the pedal 32 and the handle 43 is rotated rearward raising the hook 18 which cooperates with the floor or other contact surface below the shoe 16 to bend the conduit around the shoe 16. The bend imparted to the conduit or tubing as the shoe 16 is rotated has a radius substantially equal to that of the arcuate portion 112 at which the shoe 16 is curved along its length. The angle produced in the conduit can be determined by the user either by viewing along the vertical sight lines 106 and verifying the angle with the numerical angle markings 120 on the shoe 16, when operated as described, or by comparison to the horizontal angle lines on the shoes 16, when operated in the alternate way described above.

In the event that the conduit has been bent beyond the selected angle the handle 12 can be rotated in the opposing direction wherein the grip 43 is rotated forward and the conduit extending forward beyond the hook 18 is in the channel provided between the saddles 122 and 124. As the handle is rotated, the opposing end of the conduit can be bent back against the underlying contact surface. The opposing end can be, for example, held down by the foot of the user as the handle is rotated, wherein the bend angle can be reduced or straightened. As the contact surfaces for the conduit during the bend back process are the saddles 122 and 124, each of which comprise rounded surfaces sized and dimensioned for receiving the conduit, the conduit can be bent back to a desired bend angle without kinking, gouging, or otherwise damaging the conduit.

As described above, in the event that the conduit needs to be cut or de-burred, the conduit can also be positioned in one of the first and second vice apertures 100 and 102, which are also sized and dimensioned to receive and grip the conduit. Then the handle can be rotated against the conduit to wedge the conduit into the corners of the vice. Also, as described above, each of these vice apertures 100 and 102 is provided with a thermoelastic polymer (TEP) coating 103 such that the conduit inserted into the vice 100 and/or 102 is not bent or damaged. The vice aperture 100 or 102 retains the conduit in position wherein it can be easily worked on by a user or operator in order to cut, de-burr or otherwise alter the conduit. Also as described above, the ruler 116 in handle 12 can also be used by a user in order to verify the length of a conduit, verifying the length of electrical leads, or for providing other measurement as required.

Although a conduit bender 10 has been described as comprising an integral handle 12 and head portion 14, it will be apparent that many of the described features can also be applied to a conventional conduit bender including a separate head 14 and handle 12 portion. For example, the vertical and horizontal sight line 106 and 108 configurations, respectively, as described above can also be provided on a traditional, metal head 14. Furthermore, saddles 122 and 124 for limiting damage to conduit or tubing while it is bent back or partially straightened away from an initial bend angle can also be provided on traditional conduit benders. A pedal provided on top of a straight section of the channel at the opposite end of the arcuate channel from the hook could also be applied to a traditional bender head. It will be apparent to those of ordinary skill in the art that other features described above can also be provided in conjunction with traditional conduit benders.

A preferred embodiment of a conduit bender of the invention has been described in considerable detail. Many modifications and variations to the preferred embodiment described will be apparent to a person of ordinary skill in the art. Therefore, the invention should not be limited to the embodiment described.

We claim:

1. A molded plastic conduit bender, the conduit bender comprising:

a handle sized and dimensioned to be grasped by a user's hand;

an arcuate shoe portion integrally molded to a distal end of the handle, the shoe portion including a channel for receiving a conduit to be bent;

a hole sized and dimensioned to receive a user's hand adjacent to the arcuate shoe portion.

2. The conduit bender as defined in claim 1, further comprising a steel hook pivotally coupled to an end of the arcuate shoe portion.

3. The conduit bender as defined in claim 1, wherein the arcuate shoe includes a base surface which may be rotated against the floor when bending a conduit, said base surface including markings indicative of the angle of bend.

4. A molded plastic conduit bender, the conduit bender comprising:

a handle sized and dimensioned to receive a user's hand;

an arcuate shoe portion integrally molded to a distal end of the handle, the shoe portion including a channel for receiving a conduit to be bent;

a steel hook molded into the handle adjacent an end of the arcuate shoe portion, wherein a conduit provided in the shoe is receivable in the hook to be bent to a selected angle by the shoe.

5. The conduit bender as defined in claim 4, wherein the handle comprises a hole for receiving a user's hand.

6. The conduit bender as defined in claim 4, wherein the handle further comprises at least one vice aperture sized and dimensioned to receive and provide a vice-like grip on the conduit.

7. The conduit bender as defined in claim 6, wherein the vice aperture includes a layer of elastomer material.

8. The conduit bender as defined in claim 4, further comprising a plurality of sight lines extending from an apex on a side of the handle, the sight lines being positioned to provide an indicator of a bend angle for the conduit.

9. The conduit bender as defined in claim 4, further comprising a plurality of horizontal sight lines molded into an edge of the contact surface of the shoe portion, each of the horizontal sight lines being positioned to provide an indicator of a bend angle for the conduit.

10. The conduit bender as defined in claim 4, further comprising at least one numerical angle marker, the numerical angle marker providing a numerical indicator of a bend angle.

11. The conduit bender as defined in claim 10, wherein the numerical angle marker is molded into the handle below a contact surface.

12. The conduit bender as defined in claim 10, wherein the numerical angle marker is permanently marked on the handle.

13. The conduit bender as defined in claim 11, wherein the numerical angle marker comprises a recessed base portion including a numerical symbol, and a wall enclosure extending above the base portion, the wall enclosure being sized and dimensioned to prevent the base portion from contacting an underlying surface when the handle is laid on a side including the numerical angle marker.

14. The conduit bender as defined in claim 4, further comprising a plurality of distance marks comprising a ruler provided along at least one side of the handle.

15. The conduit bender as defined in claim 4, wherein the steel hook comprises a grid mounting portion for receiving molten plastic.

16. The conduit bender as defined in claim 4, wherein the steel hook comprises a substantially flat portion, the flat portion including a rounded saddle sized and dimensioned for receiving the conduit at one end and to apply a force to the conduit to straighten the conduit.

17. The conduit bender as defined in claim 4 further comprising a grip comprising an elastomer material provided at an end of the handle opposite the shoe.

18. The conduit bender as defined in claim 17, wherein the grip further comprises a steel tube insert.

19. A head for a conduit bender, the head comprising:

a semi-circular shoe including a channel for receiving a conduit;

a plurality of sight lines, each of the sight lines extending from an apex point and extending to the shoe, each of the sight lines being aligned with a bend angle to provide an indicator to the user of a bend angle for the conduit in the shoe when the sight line is vertical; and a plurality of horizontal sight lines, provided along an edge of the shoe and spaced to provide a bend angle for a conduit bent by the shoe.

20. The head as defined in claim 19, further comprising at least one recessed numerical angle marker provided in the side of the head, the numerical angle marker correlating with one of the sight lines to provide a numerical indicator of a bend angle.

21. A head for a conduit bender, the head comprising:

an arcuate shoe including a concave channel for receiving a conduit;

a hook portion provided adjacent an end of the arcuate shoe, the hook portion receiving the conduit extending from the arcuate shoe and providing a bending force on the conduit when rotated in a bending direction;

a mounting surface provided opposite the hook, the mounting surface including a first rounded saddle portion sized and dimensioned to receive a conduit at a distal end, the first rounded saddle portion being positioned spaced radially from the arcuate shoe; and a second rounded saddle portion coupled adjacent to a back end of the hook, the second rounded saddle surface being provided a distance from the first saddle portion selected to receive the conduit between the first and second saddle portions, wherein when the head is rotated in a bending direction the conduit is bent against the contact surface and when the head is rotated in a direction opposite the bending direction, the conduit is cradled between the first and second rounded saddle portions, allowing a bent length of conduit contacting a surface to be bent back against the contact surface to reduce an angle of the bend.

22. A conduit bender comprising:

a handle sized and dimensioned at one end of the conduit bender to be grasped by a user's hand;

a head at the end of the conduit bender which is opposite from the handle, the head having an arcuate shoe portion including a hook at one end and including an arcuate channel for receiving a conduit to be bent;

wherein the handle and head are integrally formed in one plastic piece; and the hook includes a metal insert embedded in the head.

23. The conduit bender as defined in claim 22, wherein the conduit bender includes at least two concavely shaped bend back saddles, at least one of which is on a side of the handle which is adjacent to and faces a rear side of the hook and at least one of which is on the rear side of the hook, wherein the bend back saddles are sized and shaped to cradle a section of conduit which extends between them when the handle is rotated relative to the section of conduit in a direction opposite to a normal direction of bending, the normal direction of bending being the direction the handle is rotated when the conduit is bent in the arcuate channel of the shoe.

24. The conduit bender as defined in claim 22, wherein the handle further comprises at least one vice aperture sized and dimensioned to receive and provide a vice-like grip on the conduit.

25. The conduit bender as defined in claim 24, wherein the vice aperture is oriented so as to position a diagonal of the aperture generally parallel to a longitudinal axis of the conduit bender.

26. The conduit bender as defined in claim 24, wherein the vice aperture includes a layer of elastomer material.

27. The conduit bender as defined in claim 22, further comprising a plurality of sight lines extending from an apex where the lines meet on a side of the head to a position of each line adjacent the arcuate channel of the shoe, the sight lines extending from the apex at different angles to provide an indicator of a bend angle for the conduit when the bender is rotated against a floor surface until the corresponding line is vertical.

28. The conduit bender as defined in claim 27, further comprising a plurality of sight lines molded into said side of the head, the sight lines being positioned and oriented at different angles to provide an indicator of a bend angle for the conduit when the bender is rotated against a floor surface until the corresponding line is horizontal.

29. The conduit bender as defined in claim 27, further comprising at least one numerical angle marker molded into the head, the numerical angle marker providing a numerical indicator of a bend angle and being recessed so as to be positioned below a contact surface on the adjacent side of the conduit bender.

30. The conduit bender as defined in claim 22, wherein the handle has an open end and is hollow, and includes a metal tube embedded in a material of the handle and head into which a conduit may be inserted.

31. The conduit bender as defined in claim 22, wherein portions of the conduit bender are overmolded with an elastomeric material.

32. The conduit bender as defined in claim 22, wherein the bender includes a measuring ruler formed into it.

33. The conduit bender as defined in claim 22, wherein the head further includes a hook at one end of the shoe and a straight channel section which extends from the arcuate channel of the shoe at an end of the shoe which is opposite from the hook, the straight channel section having an end where it terminates opposite from the arcuate channel of the shoe, and wherein a footrest is formed on the end of the straight channel section.

34. The conduit bender as defined in claim 23, wherein the bend back saddles are in part formed by a metal insert which is embedded in the material of the conduit bender.

* * * * *

UNITED STATES PATENT AND TRADEMARK OFFICE

CERTIFICATE OF CORRECTION

PATENT NO. : 6,820,457 B2
DATED : November 23, 2004
INVENTOR(S) : Thomas M. Luebke et al.

It is certified that error appears in the above-identified patent and that said Letters Patent is hereby corrected as shown below:

Column 2,
Line 11, "for receiving a" was deleted between "…including a channel…" and "...conduit to be bent…".

Column 4,
Line 39, "22" was deleted between "10" and "30".
Line 42, "angled" should be -- angles --.

Signed and Sealed this

Nineteenth Day of April, 2005

JON W. DUDAS
*Director of the United States Patent and Trademark Office*